United States Patent [19]

Doublet

[11] Patent Number: 4,646,807

[45] Date of Patent: Mar. 3, 1987

[54] HOOKING DEVICE FOR SAFETY BARRIERS

[76] Inventor: Luc Doublet, 80, rue Burgault, 59113 - Seclin (Nord), France

[21] Appl. No.: 688,581

[22] Filed: Jan. 3, 1985

[51] Int. Cl.[4] ..... E01F 13/00; E04H 17/00

[52] U.S. Cl. ..... 160/135; 160/351; 160/352; 256/24

[58] Field of Search ..... 160/352, 351, 135; 256/24, 25, 26, 59, 65

[56] References Cited

U.S. PATENT DOCUMENTS

| | | | |
|---|---|---|---|
| 978,550 | 12/1910 | Boyd | 248/211 |
| 3,423,072 | 1/1969 | Bernstein | 256/24 |

FOREIGN PATENT DOCUMENTS

| | | | |
|---|---|---|---|
| 1282729 | 12/1961 | France | 256/24 |
| 1297804 | 5/1962 | France | 256/24 |
| 1368196 | 6/1964 | France | 256/24 |
| 2302385 | 2/1975 | France | 160/135 |

*Primary Examiner*—Reinaldo P. Machado
*Attorney, Agent, or Firm*—Robert E. Burns; Emmanuel J. Lobato; Bruce L. Adams

[57] ABSTRACT

A plurality of similar barrier section connectable demountably for forming in assembly dismantable safety barrier. Each barrier section has a frame with upstanding opposite end members. Horizontal members are connected to the end members to define the frame. The frame has inside thereof members so that a fence can be formed with the individual barrier sections. Each frame has feet thereon to maintain the corresponding frame generally stably upstanding. Each of the barrier sections has two hooks fixed spaced vertically on each same upstanding end member of the frame of the corresponding barrier section. Each hook has a straight part extending generally horizontally away from the same end member of each of the individual frames and generally parallel with a corresponding side of the frame. Each of the two hooks has a reversely bent free end forming a loop open toward the corresponding end member on which the hook is disposed. The two loops of the two hooks are looped toward each other. The opposite end member of another barrier section is received in the loops when the barrier sections are assembled into a barrier and are held from unintentionally being moved away from each other.

5 Claims, 6 Drawing Figures

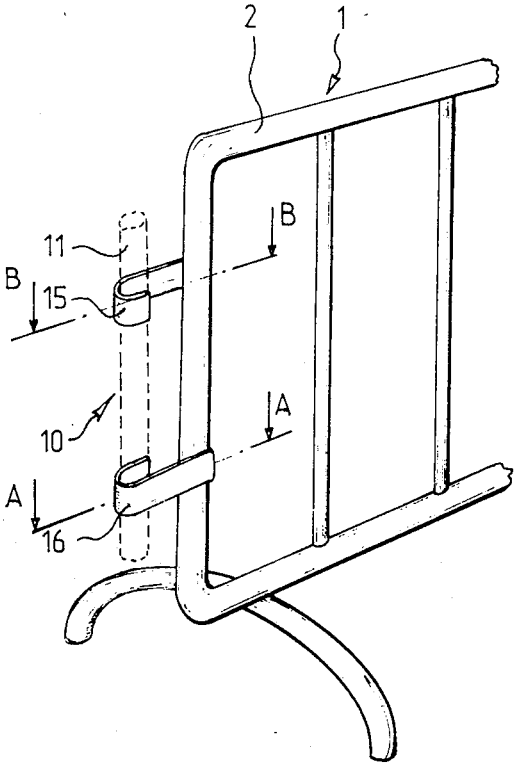
FIG.2
FIG.4
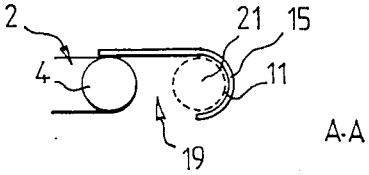
A-A
FIG.5
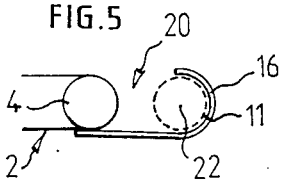
B-B
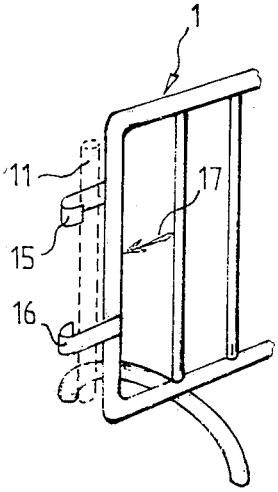
FIG.3a
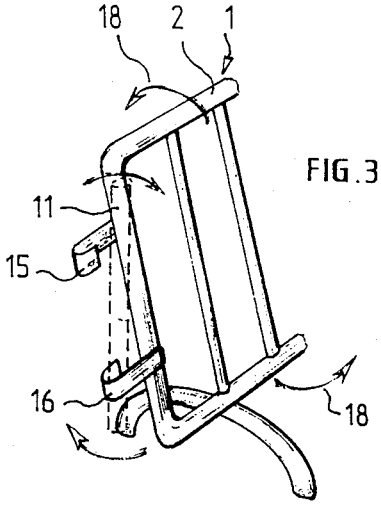
FIG.3b

HOOKING DEVICE FOR SAFETY BARRIERS

BACKGROUND OF THE INVENTION

This invention relates to a hooking device for a safety barrier. It will find in particular its application for forming a continuous rampart around a forbidden zone.

The utilization of safety barriers is largely in general use nowadays in order to surround dangerous zone not authorized to the public. The safety barriers are disposed one after another and hooked together so as to form a continuous rampart.

The safety barriers are generally made up of a plane tubular frame having a series of inner longitudinal small bars. The whole is mounted on feet which thus assure an equilibrium to the barrier.

The hooking fashion utilized for joining the barriers is very varied. We know for instance the utilization of a simple hook placed on one of the posts of the barrier when the other post is provided with a ring. Thus, the barriers can be successively hooked one after another, each of the hooks of a barrier fitting into the rings of the next barrier.

It is in question a rudimentary hooking device which does not give satisfaction from the fact that it does not exist no bolting of the assembly. Thus, the barriers can be separated one among the other accidentally, only by raising one from them with respect to its neighbour. As very often they play a part of rampart with regard to a danger, such a possibility of separation is unacceptable.

So, the constructors have proposed various hooking devices which possess moreover a bolting of the assembly.

Thus, we know safety barriers provided with a frame whose one of the posts is formed like a rectangular flat having a weak thickness. Likewise, the other post of the safety barrier is fitted with a split ring whose the opening of the slit appreciably corresponds to the aforesaid flat thickness. The introduction of the post provided with a flat into the split ring only can consequently be realized according to a certain angular position with respect to the slit, and as soon as the flat is introduced into the split ring, it is possible again to pivot the barriers which were just hooked without being possible to disconnect them unless again they retake the angular orientation of unbolting, i.e. when the weak thickness of the flat corresponds with the opening of the ring slit.

With this type of barrier, the bolting is always present except for a determinate angular position. It is the matter of a handicap which can be particularly proven cumbersome when for instance the barriers are utililized as an angle at a street corner. Indeed, it may be possible that the angular position which must be adopted to follow the profile of the obstacle, precisely corresponds to the angular position of unbolting of the barriers, in which case they can not actively play their safety part.

In order to mitigate this drawback certain constructors have utilized split rings whose the slit is inclined with respect to the longitudinal direction of the barrier. With this type of barrier, the bolting is realized regardless the angular orientation adopted for two joined barriers.

On the other hand, since the unbolting, just as the disconnecting are realized when a barrier is inclined with respect to the other, this configuration can be encountered when, for instance, the barriers are disposed on a ground whose the declivity varies. Indeed, the alignment of the barriers in the longitudinal direction being no more encountered owing to the modifications of the ground slope, it will be encountered, for a given inclination, two consecutive barriers having no more the bolting essential to the safety of the whole.

Consequently, amid the different hooking devices at the present time offer on the market by the constructors, no one is not entirely satisfying since, according to the nature of the utilisation of the safety barriers, certain among them would not have no bolting.

By another way, the choice of an intricate bolting appealing or utilizing removable components such as bolts can not be contemplated in the application of safety barriers because a second primordial factor in their utilisation rests in the mounting and dismounting facility. Indeed, it is in question removable barriers often provisionally put in position and it is essential that the mounting and dismounting time be very short.

SUMMARY OF THE INVENTION

The principal object of this invention is to provide a hooking device for safety barriers which warrants the bolting of the mounting regardless the angular orientation of consecutive barriers and moreover regardless the longitudinal inclination of said assembled barriers.

Consequently, the differents drawbacks encountered hitherto exist no more with the safety barriers provided with the hooking device of this invention. Besides, the hooking device of this invention can be put in position on barriers realized according to the present process of manufacturing generally utilized.

Another object of this invention is to provide a hooking device whose the implementation is very simple and need no tooling. Consequently, the mounting and dismounting time of the barriers realized according to this invention is short and need no important physical endeavour. Thus, their handling remains easy.

Another advantage of this invention consists in the fact that when a line of barriers has been assembled, the dismounting of said line of barriers can only be considered from a successive dismounting of the utmost barriers.

Thus, by assuring that the utmost barriers can not be dismounted, for instance, by fixing the latter to the ground or hooking the latter on a fixed obstacle, the security service can be certain that the line of safety barriers can not be broken at any level of its central part. This particularity is especially advantageous in so far as it permits to minimize the supervision points which thus only should be located at the level of the utmost barriers.

The particularity that presents the hooking device of this invention allows to utilize the safety barrier, which is provided with said device, in undulating countries or on grounds on an espalier.

Another object of this invention is to permit to the hooking device to suit to a next barrier and a pole. It could be in question for instance a road sign pole in which case said pole is a fixed obstacle which warrants the non-disconnecting possibility of the barrier to this level. It is also possible to utilize as hooking point a small bar whose the safety barrier are provided with. This ability permits to connect T-barriers, what generally was not feasible with the prior bolting device.

Other objects and advantages of this invention shall appear in the description which follows, which is only given nevertheless as illustrative and whose the purpose is not to limit it.

The hooking device of the safety barriers especially intended for forming a continuous rampart around a forbidden zone, said barrier being composed of a plane tubular frame provided with lateral posts and horizontal stringers surrounding small bars or gratings, said frame being moreover provided with feet which assure it an equilibrium on the ground, is characterized in that the frame comprises removable hooking means on a post, dividing in at least two parts having respectively a dislocation possibility of said alternate post.

THE DRAWINGS

This invention will be better comprised by reading the following description accompanied with the appended drawings, among which:

FIG. 2 shows a perspective view of a preferred embodiment of the hooking device of this invention, FIG. 3*a* and 3*b* schematize the different stages of the hooking of a safety barrier.

FIG. 4 represents a cross-section according to the axis A—A of FIG. 2, and FIG. 5 shows a cross-section according to the axis B—B of FIG. 2.

DESCRIPTION OF THE PREFFERED EMBODIMENTS

Figure 1:
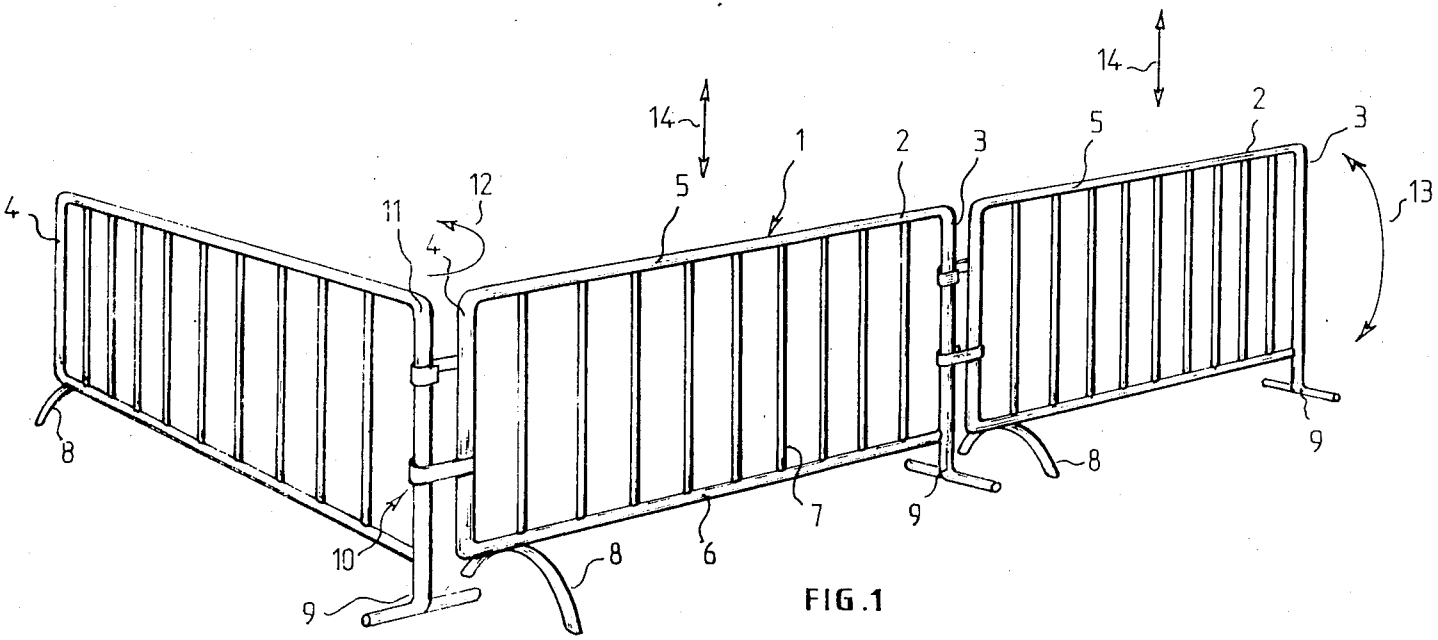
FIG. 1 shows a comprehensive view of the safety barrier provided with the hooking device of this invention.

This invention relates to a hooking device of safety barriers. It is in question mobile modular barriers intended for being assembled together in order to form a continuous rampart around a forbidden zone.

The joining device which joins up the barriers generally permits to orientate the latter in order that the continuous line formed by the barrier assembly can be disposed according to curves or in grounds having a declivity.

Furthermore, the safety barriers must have, when they are hooked, a bolting which impedes their dismounting in order to ensure the security of the formed rampart.

FIG. 1 shows a safety barrier provided with a hooking device according to a preferred embodiment of this invention.

The safety device 1 is composed of plane tubular frame 2. Nevertheless, it is in question a non-limiting embodiment; indeed, as shall appear from the following description, the frame whose the barrier is provided with, can be in any form in particular; a bent form having a profile adapted to surround the curves can also be utilized.

The construction of the frame, as showed in FIG. 1, utilizes a set of mechanically welded and curved tubes; however, other profiles could also be utilized without for all that going out of the scope of this invention. Particularly, some solids rods can perfectly be employed.

Because it is generally in question a material intended for being utilized in the open air and therefore capable to undergo the bad weather, it will be employed galvanized steel tubes.

The plane tubular frame 2, generally in the rectangular shape, comprises two lateral posts 3 and 4 and two horizontal stringers 5 and 6.

For constructing the whole, it could be employed a tube bent at the level of angles and welded to assure the frame closing.

The frame surrounds a series of seven small bars as showed in FIG. 1; however, another means of protection can be utilized, such as a grating.

This whole is mounted on feet 8 and 9 which assure a vertical equilibrium.

Different types of feet can be utilized, particularly a type of bent feet, as indicated by 8 in FIG. 1 and which is composed of two clamps projecting on both sides of the frame and resting on the ground. The other foot 9 viewed in FIG. 1 can be composed of an extension of the post 3 which forms a projection till the ground. This type of mounting provides a good stability to the safety barrier and by another way minimizes the outer bulkiness of the latter.

Besides, according to the characteristics of this invention, the frame 2 comprises removable hooking means on a post 11. This post 11 can be formed like a vertical pole situated in the ground, as showed in FIG. 1, or can be the lateral post of a next safety barrier.

The properties of the removable hooking means 10 of this invention provide to the safety barrier a bolting with respect to the post 11 in every instance encountered during the utilization of the safety barrier.

In particular, a pivoting according to anyone orientation of the barrier 1 with regard to the post 11 as indicated by the arrow 12 does not affect the bolting.

Under these conditions, the utilization of the safety barrier according to a configuration like an arc of circle, such as encountered in the curves, can perfectly be considered surely; indeed, no unhooking is not to fear regardless the angular orientation of the consecutive barriers the one with respect to the other.

By another way, an inclination orientated according to the plane of the frame 2 of the safety barrier 1, as indicated by the arrow 13 in FIG. 1, also does not effect the bolting of the safety barrier.

This possibility of dislocation in the plane of the frame 2 of the safety barrier 1 will be particularly appreciated during the putting in position of a line of barriers on an undulating ground; as a matter of fact, the variation of the ground declivity constrains to position the consecutive barriers which form a continuous line, with a certain angular inclination of the barriers the one with respect to the other according to the frame plane. Now, this putting in position does not affect the bolting means regardless furthermore the presented angular inclination. The hooking device of this invention consequently allows to warrant regardless the circumstances, the security imperatives.

Another operation also authorized with the hooking device of this invention is the hooking possibility with variations according to the vertical direction, as indicated by the arrow 14 in FIG. 1.

In certain configurations such as these encountered during the putting in position of the safety barriers on grounds having some level variations such as grounds on an espalier, this bolting property with changes of level of the barriers the one with respect to the other will be particularly appreciated for its efficiency.

According to this invention, the removable hooking means 10 divide in at least two components 15 and 16 having a dislocation possibility of said alternate post, as showed in FIG. 2. By dislocation possibility, it must be understood the disengaging of the post 11 from the hooking means. It follows that since each of the hooking means has a dislocation possibility orientated in a direction opposite with regard to the other, this in relation to the plane of the frame 2, the bolting is always realized when the barrier rests on the ground.

The unbolting of the hooking means 10 according to this invention is tied up to the unhooking of the safety barrier 1. The unbolting is effected by inclining the plane of the frame 2 of the barrier with regard to the vertical, i.e. with respect to the hooking post 11.

This invention has the particularity to tie up the hooking to the bolting, i.e. so long as the barrier is hooked to a post, it is bolted on this post. As the unbolting can only be contemplated by inclination of the plane of the frame 2 with respect to the hooking post 11, the unhooking could only be considered from the moment where the safety barrier could be inclined, i.e. itself will be no more hooked to the next barriers, whence a security of the assembly, since every group of assembled barriers could only be disconnected from the successive unhooking of the utmost barriers.

The differents unhooking stages of a barrier 1 of a post 11 are depicted in FIG. 3*a* and 3*b*. It will be admitted for the demonstration that the hooking post 11 is fixed. In which case, it is at first necessary to bring the barrier 1 nearer to the post 1, as indicated by the arrow 17 in FIG. 3*a*.

As soon as this operation is realized, the hooking means 15, for instance, offers a possibility of dislocation of the post 11 in the direction of one of the sides of the safety barrier 1, when the hooking means 16 present a possibility of dislocation of the post 11 according to the opposite direction. Under these conditions, even at the end of this operation, the bolting remains present. On the other hand, when the frame 2 of the safety barrier 1 is inclined, as showed in FIG. 3*a*, the rotation of the barrier, as indicated by the arrows 18 in FIGS. 3*b*, permits a dislocation of the post 11 of each hooking means 15 and 16. And only at the end of this operation, the barrier finds itself at one and the same time unhooked and unbolted. The operation can not be accidentally realized since it is necessary that the barrier 1 leaves the ground.

For ensuring the assembly and the bolting of safety barriers 1 on posts 11, the operation contrary to these previously presented must be successively realized.

It is also possible to note that the dismounting and the unbolting of a safety barrier 1 on a past can only be contemplated from the moment where the barrier can undergo a rocking, what is not feasible if itself is hooked to other barriers, what warrants the inviolability of the hooking means and bolting means on a line of assembled barriers.

FIGS. 4 and 5 respectively show the sections A—A and the sections B—B of the hooking means depicted in FIG. 2.

The hooking means occur in the form of two hooks 15 and 16 fixed to the post 4 of the frame 2. According to this invention, only one of the posts of the frame 2 must be provided with hooking means of this invention, since these are intended for being fixed to a vertical post which can be a smooth post, such as this whose the safety barrier 1 is originally provided with.

The hooks 15 and 16 respectively have introduction apertures 19 and 20 of the alternate hooking post 11 with respect to the plane of the frame 2.

The hooks 15 and 16 have the shape of a clamp fixed to the post 4 of the barrier 1 and curved at its end according to a half-circle. Other forms of curves could however be adopted, since generally the tubular posts on which must fasten on the devices of this invention are cylindrical; the geometrical form is the most appropriate.

The respectives centres 21 and 22 of the half-circles of the hooks 15 and 16 are aligned with respect to the post 4 of the frame 2 to which they are fixed. This alignment allows to the barrier 1 to be fixed to the vertical posts 11. The length of the clamp which is useful to the manufacture of the hooks is such that the distance between the centre of the half-circle 21 and 22 of the clamp end and the post 4 to which they are fixed is larger than the transversal dimension of the hooking posts 11. This is a necessary condition so that hooking is removable. This distance, just as the spacing of the hooks 15 and 16 should be established as a function of the barrier dimensions and so as these can suit to the different configurations of contemplated utilisations.

Others implementations of this invention, within the understanding of the skilled man, can also be contemplated without for all that departing from the scope of the invention.

What is claimed is:

1. A plurality of barrier sections connectable demountably for forming in assembly a dismantable safety barrier, each barrier section having a frame with upstanding opposite end members, horizontal members connected to the end members to define the frame, and members in the frame for forming a fence with the individual safety barrier sections, feet on said frame of each barrier section to maintain the frame generally stably upstanding, the improvement comprising same means on each barrier section for demountably connecting the barrier sections in a dismantable assembly defining a safety barrier, said same connecting means comprising two hooks on only each same upstanding end member of each frame of the corresponding barrier section, said two hooks being disposed fixed spaced vertically on the same corresponding upstanding end member of each frame, each of said two hooks of each barrier section having a part extending generally horizontally away from said same end member of the individual frame and generally parallel with a corresponding side of the frame, said part of one of the hooks being disposed extending from one side of the frame and said part of the other hook extending away from the other side of the frame, each of said two hooks of each barrier section having a free end reversely bent in an individual loop bent toward the opposite side of the corresponding frame from the side from which the hook extends so that the loops of the two hooks are disposed looped toward each other, each individual loop of each hook of each barrier section being open toward said same end member of the corresponding frame for removably receiving in each hook loop an end member of the opposite end of a frame of one of said plurality of barrier sections for connecting the barrier sections without having to lift the sections relatively for effecting a connection of the barrier sections, and the opposite end member of said one of said plurality of barrier sections is held by the loops of the two hooks in which it is received from moving laterally and held from unintentionally being moved away from the barrier section which it is hooked.

2. A plurality of barrier sections connectable demountably for forming a dismantable safety barrier according to claim 1, in which each of the barrier sections is structurally of the same dimensions.

3. A plurality of barrier sections connectable demountably for forming a dismantable safety barrier according to claim 1, in which the barrier sections are structurally of the same dimensions except as to length.

4. A plurality of barrier sections connectable demountably for forming a dismantable safety barrier according to claim 1, in which said end members are cylindrical and the loop of the two hooks thereon are semicircular.

5. A plurality of barrier sections connectable demountably for forming a dismantable safety barrier according to claim 1, in which said part of each of said two hooks is straight and the loop thereon is a continuation of the straight part of the corresponding hook.

* * * * *